United States Patent [19]

Putnam et al.

[11] 4,314,444

[45] Feb. 9, 1982

[54] HEATING APPARATUS

[75] Inventors: Abbott A. Putnam; David W. Locklin, both of Columbus, Ohio

[73] Assignee: Battelle Memorial Institute, Columbus, Ohio

[21] Appl. No.: 161,802

[22] Filed: Jun. 23, 1980

[51] Int. Cl.[3] ..... F02C 5/11

[52] U.S. Cl. ..... 60/39.77; 122/24

[58] Field of Search ..... 60/39.76, 39.77, 39.79, 60/39.8, 247, 248, 249; 122/24

[56] References Cited

U.S. PATENT DOCUMENTS

| | | | |
|---|---|---|---|
| 2,115,644 | 7/1950 | Goddard | 60/39.77 |
| 2,525,782 | 10/1950 | Dunbar | 60/249 |
| 2,546,966 | 4/1951 | Bodine | 60/225 |
| 2,748,753 | 6/1956 | Sarrazin et al. | 60/39.77 |
| 2,878,790 | 3/1959 | Paris et al. | 122/24 |
| 2,998,705 | 9/1961 | Porter et al. | 60/249 |
| 3,171,465 | 3/1965 | Rydberg | 122/24 |
| 3,183,895 | 5/1965 | Haag | 122/24 |
| 3,188,804 | 6/1965 | Melenric | 60/249 |
| 3,606,867 | 9/1971 | Briffa | 122/24 |
| 3,848,408 | 11/1974 | Tompkins | 60/39.77 |

FOREIGN PATENT DOCUMENTS

| | | | |
|---|---|---|---|
| 750516 | 1/1945 | Fed. Rep. of Germany | 60/39.77 |

OTHER PUBLICATIONS

Putnam, A.A., "General Survey of Pulse Combustion" from *Proceedings of the First International Symposium on Pulsating Combustion*, University of Sheffield, Sheffield, England, Sept., 1971.

Putnam, A. A., "A Reveiw of Pulse Combustion Technology" from *Pulse Combustion Technology for Heating Applications,* Symposion at Argonne National Laboratory, Nov., 1979.

*Primary Examiner*—Louis J. Casarecola

*Attorney, Agent, or Firm*—C. Henry Peterson; Philip M. Dunson

[57] ABSTRACT

In a two-stage apparatus for burning a fuel and a combustion-sustaining gas such as air, the first stage (12) comprises pulse combustors (16) supplied with an excess of fuel. The excess fuel is burned in a second combustion stage (14) with gas that is aspirated using the backflow through the aerodynamic valve inlet (20) of the pulse combustor and delivered, e.g. via a duct (40), to the second combustion stage. Heat is extracted from the first stage using a heat-transfer medium (46) such as water. Heat is also extracted from the combustion products of the second stage to produce substantially cooled combustion products, a portion of which recirculates, e.g. through the ducts (54) and (58) and an aerodynamic valve (60), to each pulse combustor. The rest of the cooled combustion products are exhausted, e.g. at (64), with only a low content of objectionable compounds formed from nitrogen in the fuel and the combustion-sustaining gas.

8 Claims, 2 Drawing Figures

HEATING APPARATUS

TECHNICAL FIELD

This invention relates to heating apparatus utilizing one or more pulse combustors in a first combustion stage that separately supplies both incomplete combustion products and a combustion-sustaining gas to a second combustion stage. Heat is extracted both from the pulse combustors in the first stage and from the combustion products of the second stage, thus producing substantially cooled combustion products. A portion of the cooled combustion products is recirculated to the first-stage pulse combustors so as to dilute the combustion-sustaining gas, e.g. air, supplied thereto. The remainder of the cooled combustion products is exhausted, e.g. to the atmosphere, with a substantially low content of objectionable compounds formed from the nitrogen in the fuel and the combustion-sustaining gas. Substantial noise cancellation is achieved with multiple pulse combustors and acoustically tuned components.

BACKGROUND

Pulse combustors are the subject of two papers by one of the present inventors, Abbott A. Putnam; one entitled "General Survey of Pulse Combustion," in Proceedings of the First International Symposium on Pulsating Combustion, Sept. 20–23, 1971, University of Sheffield S1 3JD, England, and the other entitled "A Review of Pulse-Combustor Technology" presented at a symposium on Pulse Combustor Technology for Heating Applications at Argonne National Laboratory, Nov. 29–30, 1979.

Other related information is contained in U.S. Pat. Nos. 2,515,644 Goddard; 2,525,782 Dunbar; 2,546,966 Bodine; 2,878,790 Paris; 2,911,957 Kumm; 2,998,705 Porter; 3,118,804 Melenric; 3,267,985 Kitchen; 3,323,304 Llobet; 3,365,880 Grebe; 3,498,063 Lockwood; 3,792,581 Handa, and 4,033,120 Kentfield.

A well designed pulse combustor exerts a powerful pumping action. Hence, a small heating unit can automatically ingest a very large volumetric flow of air (or other combustion sustaining gas). It can eject its combustion products with great turbulence and velocity, under substantially high pressure. The combustion products can thus be forced through relatively long, narrow, and tortuous passages in a heat exchanger. The turbulence contributes to an overall high efficiency of heat transfer and to a self-cleaning action on the exchanger surfaces. The temperature of the combustion products can be reduced enough to condense the water vapor and thereby recover the heat of vaporization. Because of the high resistance to flow through the pulse combustor and the heat exchanger, there is very little loss of heat by convection when the pulse combustor is turned off. With the low exhaust temperature, a plastic exhaust duct can be used. No flue, chimney, or draft hood is needed. These factors together with the small size of the unit required for a given heat output allow for great flexibility of installation, including retrofit to existing heaters and boilers, at reduced capital cost.

Despite the foregoing advantages, the development of heating systems using pulse combustors has been held back by the problems mainly of noise and vibration reduction. These problems have seemed to defy analytical solution and to admit of only expensive and time-consuming emperical solutions. However, the last few years have been marked by fuel shortages and skyrocketing fuel cost. Pulse combustor systems can provide fuel savings, and this provides a major incentive to concentrate substantial financial and technical resources on the solutions to these problems. In his first article, supra, Putnam has shown basically how the use of multiple pulse-combustor units with tuned elements can provide acoustic cancellation of noise components as a practical solution to the noise problem.

Because of environmental considerations and restrictions, there has been some concern with the possibility that the use of pulse combustors in heating units might increase the production of objectionable nitrogenous compounds, e.g. nitrogen oxides ($NO_x$). However, in his first article Putnam has pointed out that a two-stage unit, using pulse combustors fired fuel-rich and with intercooling in the first stage, could be operated with reduced production of $NO_x$. In the two-stage units, secondary air is added at the exit of the resonance tubes to burn the excess fuel. As is known, the backflow from pulsed combustors having aerodynamic valves can be used to pump the secondary air. In the pulse combustors, the bulk of the fuel-rich mixture can be burned very rapidly and the temperature of the incomplete combustion products can be substantially reduced very quickly in the resonance tubes. In the second stage, the secondary air is added to the fuel-rich products of combustion which have had some thermal energy removed. Combustion thereby continues and is completed. In the second stage, the relatively low temperature and the short combustion time suppress the formation of nitrogen oxides.

This desirable, low-$No_x$-producing operation may not be achieved in many cases, however, where it is not possible to remove heat from the pulse combustors at a sufficiently rapid rate. This problem is particularly apt to be encountered in the operation of warm air heating units.

DISCLOSURE OF INVENTION

In accordance with this invention, there is provided apparatus for burning a fuel and a combustion-sustaining gas, at least one of which contains nitrogen, and for imparting the heat generated thereby to a heat-transfer medium, the apparatus comprising a first and a second combustion stage; the first stage including a pulse combustor for burning a mixture of the fuel and the gas, the combustor having a combustion chamber, aerodynamic valve inlet means and a resonance-tube outlet means whereby the combustor is adapted to operate in a periodic cycle, each cycle including one phase wherein a major portion of combustion gases is driven out of the combustion chamber through the outlet means and a minor portion of combustion gases is driven out of the combustion chamber so as to produce a backflow through the aerodynamic valve means, each cycle also including another phase wherein a fresh charge of the combustion-sustaining gas is ingested by the pulse combustor through the aerodynamic valve means; means for supplying fuel to the pulse combustor so as to provide an excess of fuel in relation to the amount of combustion-sustaining gas ingested by the pulse combustor; the second stage including means for receiving the combustion gases from the pulse combustor outlet means and for burning the excess of fuel to produce terminal combustion products; means for supplying the combustion-sustaining gas to the aerodynamic valve means and thence to the pulse combustor; means utilizing the backflow for aspirating combustion-sustaining gas and for delivering the aspirated gas to the second stage for burning with the excess of fuel received thereat; intercooling means utilizing a heat-transfer medium for extracting from the pulse combustor in the first stage a substantial portion of the heat generated therein; means utilizing a heat-transfer medium for extracting most of the heat from the terminal combustion products produced by the second stage so as to produce substantially cooled combustion products; means for recirculating a portion of the cooled combustion products to the pulse combustor so as to dilute the combustion-sustaining gas supplied thereto, and means for exhausting the remainder of the cooled combustion products with only a low content of objectionable nitrogenous compounds formed from the nitrogen in the fuel and the combustion-sustaining gas.

A typical apparatus in accordance with the invention comprises an array of pulse combustors in the first stage, and a tuned inlet plenum as a means for supplying the combustion-sustaining gas. The aspirated combustion-sustaining gas is aspirated from the inlet plenum.

The cooled combustion products recirculating means may comprise duct means that is tuned in accordance with the repetition frequency of the periodic operating cycles of the pulse combustors. The duct means may include aerodynamic valve means.

The pulse combustors may be arranged in a toroidal array, and the cooled combustion products recirculating means may comprise duct means extending generally along the axis of the toroidal array.

At least a portion of the central duct means may be split into a plurality of branches, each branch being connected to a corresponding one of the pulse combustors in the array. Each of the branches may include aerodynamic valve means. Each of the branches may be connected to the aerodynamic valve inlet means of one of the pulse combustors.

BEST MODE FOR CARRYING OUT THE INVENTION

Figure 1:
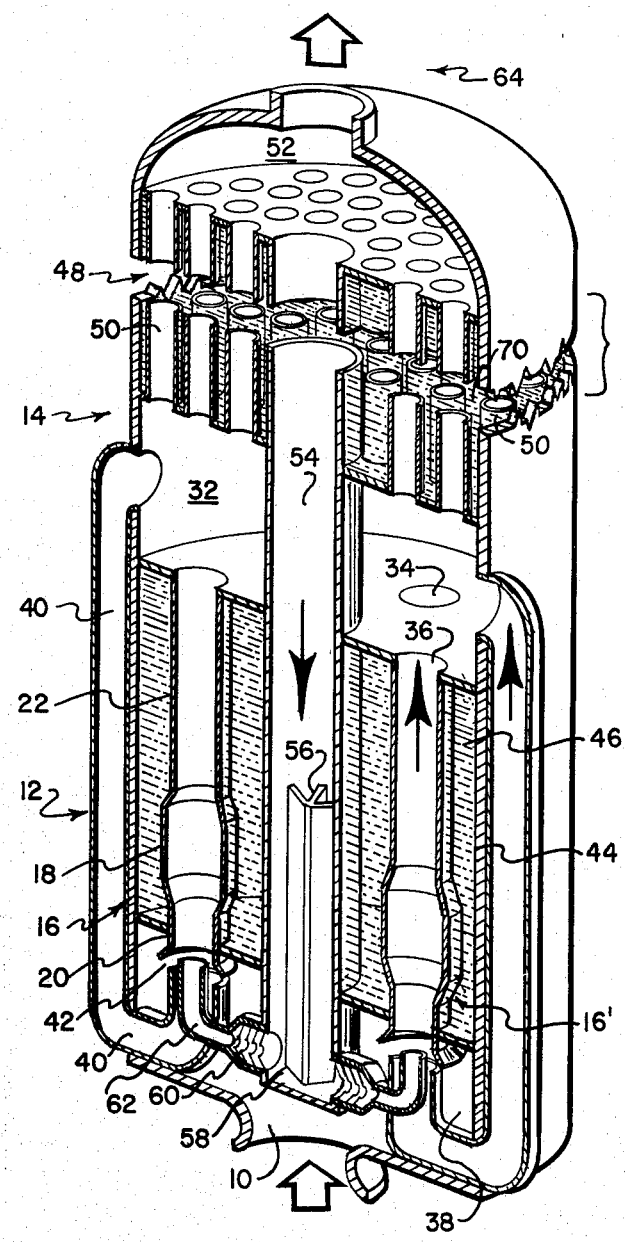
FIG. 1 is a sectional schematic view in perspective, showing the general arrangement of one typical form of heating apparatus according to the invention.

Referring now to the drawings, FIG. 1 shows an apparatus for burning a fuel and combustion-sustaining gas. Natural gas will be taken as an illustrative fuel, although the apparatus may be adapted for burning other gaseous fuels, liquid fuels, or even solid fuels such as pulverized coal, or mixtures. A typical combustion-sustaining gas is atmospheric air, which enters the apparatus through an aerodynamically-shaped inlet can. The typical combustion-sustaining gas such as air contains substantial amounts of nitrogen, as do many typical fuels. The apparatus of FIG. 1 imparts the heat generated by the burning of the fuel to a heat-transfer medium, such as air in a warm-air heating unit or to water in a hot-water heating unit.

The apparatus comprises a first combustion stage 12 and a second combustion stage 14.

The first stage 12 includes a pulse combustor as at 16. As shown in FIG. 1, the typical first stage includes an array of pulse combustors. The apparatus shown specifically contains six pulse combustors, with one additional pulse combustor being visible at 16'.

Each combustor has a combustion chamber 18, aerodynamic valve inlet means 20 and a resonance tube outlet means 22 whereby the combustor is adapted to operate in a periodic cycle.

Each cycle includes one phase wherein a major portion of combustion gases is driven out of the combustion chamber 18 through the outlet means 22 and a minor portion of combustion gases is driven out of the combustion chamber 18 so as to produce a backflow through the aerodynamic valve means 20. Each operating cycle also includes another phase wherein a fresh charge of the combustion-sustaining gas (e.g., air) is ingested by the combustor through the aerodynamic valve means 20.

Figure 2:
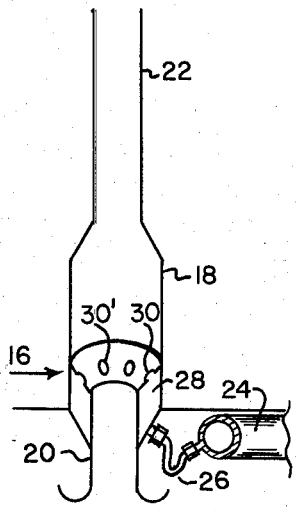
FIG. 2 is a schematic view of a portion of FIG. 1, showing details that have been omitted from FIG. 1.

In a typical arrangement, as shown in FIG. 2, natural gas is supplied to the pulse combustors 16 through an annular manifold 24 and fuel supply tubes as at 26 to a tuned fuel plenum 28 surrounding the inlet end of the combustion chamber 18. From the fuel plenum 28, the natural gas fuel is supplied to the combustion chamber 18 of the pulse combustor 16 through a plurality of drilled passages as shown at 30 and 30'. The passages as at 30 and the size of the plenum 28 are such that the natural gas fuel is delivered to the combustion chamber 18 at the proper time in the periodically recurring cycle of the pulse combustor operation. The gas pressure supplied to manifold 24 and the size of the passages as at 30 are such that there is provided an excess of fuel in relation to the amount of combustion-sustaining gas (e.g., air) ingested by the pulse combustor through the aerodynamic valve 20.

The second combustion stage 14 comprises a relatively large combustion chamber 32 that receives the combustion gases from the pulse combustor outlets. In addition to the resonance tube outlet 22, FIG. 1 shows two other outlets 34 and 36. In the second stage combustion chamber 32, the excess of fuel in the combustion gases from the pulse combustor outlets is burned to produce terminal combustion products.

Combustion-sustaining gas is supplied to the aerodynamic valve means as at 20 and thence to the combustors as at 16 by means that includes the air inlet 10 and a tuned inlet plenum 38. The plenum 38 is tuned to resonate, in a spinning mode, at the operating frequency of the pulse combustors as at 16. Typically, the pulse combustors fire at a frequency of a few hundred hertz. The combustors are arranged to fire in sequence around the circle. The inlet plenum 38 is sized in relation to the air-ingestion rate of the combustors and the size of the air inlet 10 so that a pressure wave proceeds around the circle of pulse combustors in a fixed phase relationship to the sequential firing of the pulse combustors. It is to be emphasized that it is a pressure wave and not a bodily movement of the gas in the inlet plenum, that characterizes the spinning motion. There is a substantially steady flow of air through the inlet 10, and substantial noise cancellation is obtained acoustically, without the need for a muffler.

When a pulse combustor as at 16 fires, as previously noted, a major portion of combustion gases is driven out of the combustion chamber 18 through the resonance tube outlet 22. Although the aerodynamic valve 20 offers a relatively high resistance to the flow of combustion gas from the combustion chamber 18 toward the inlet plenum 38, the aerodynamic valve 20 does permit the backflow of a minor portion of the expanding gas produced by the explosion in the combustion chamber 18. A conduit, or in the embodiment shown an array of conduits as at 40, are provided for utilizing the backflow for aspirating combustion-sustaining gas from the inlet plenum 38 and for delivering the aspirated gas to the second stage combustion chamber 32 for burning with the excess of fuel received from the combustor outlets as at 22, 34 and 36. This aspirated gas (air), as well as the air that is utilized by the pulse combustors as at 16, is drawn in from the inlet plenum 38 through the space 42 between the aerodynamic valve 20 and the end of the conduit 40.

A substantial portion (perhaps 20 percent) of the heat generated by the pulse combustors as at 16 in the first stage 12 is extracted by an intercooling means utilizing a heat-transfer medium. In the embodiment shown, the intercooling means comprises a water jacket 44 and the heat-transfer medium comprises water 46 that surrounds the pulse combustors as at 16. Either a circulating pump system (not shown) or a convection system may be used to circulate the water 46 to a heat exchanger or other heat utilization system at the point of use via an inlet and an outlet (not visible in FIG. 1). Obviously some other heat-transfer medium such as oil, heat exchanger fluid, or circulating air can be used of water 46.

A second heat exchanger section 48 extracts most of the heat from the terminal combustion products produced by the second combustion stage 14 so as to produce substantially cooled combustion products. The second heat exchanger section 48 may likewise use any suitable heat-transfer medium, such as water, oil, heat exchange fluid, or circulating air. In the embodiment shown, the terminal combustion products flow through a multiplicity of tubes as at 50 surrounded by circulating water 70. The tubes 50 are connected at the top and at the bottom by a suitable header arrangement so that the terminal combustion products flow through the multiple tube passages wherein their heat is substantially fully extracted before they are permitted to exit from the heat exchanger 48, after the manner of the well known "Scotch" boiler. Obviously a great many conventional heat exchanger designs may be adapted for use in this arrangement.

A portion of the cooled combustion products from the region 52 above the second section 48 of the heat exchanger is recirculated to the pulse combustors so as to dilute the combustion-sustaining gas supplied thereto. The recirculating means comprises a central duct 54. The bottom portion of duct 54 is divided by a fluted, axially-extending separator 56 into equal portions corresponding to the number of pulse combustors. In the illustrated example, the conduit 54 is split into six portions or branches. One branch portion 58 provides a channel that leads through an aerodynamic valve 60 and a conduit section 62 to the aerodynamic valve inlet 20 to pulse combustor 16. The passages to the other five pulse combustors from the central conduit 54 are similarly arranged.

The length of the fluted divider 56 is selected so that the passages through the conduits as at 62 are acoustically tuned to the operating frequency of the pulse combustors.

As indicated at 64, an outlet is provided for exhausting the remainder of the cooled combustion products with only a low content of objectionable nitrogenous compounds formed from the nitrogen in the fuel and the combustion-sustaining gas. The outlet 64 may be connected to an existing chimney, a plastic duct, or other suitable means for exhausting the combustion products into the atmosphere.

While FIG. 1 shows the rising portion of the secondary air ducts as at 40 to be straight and parallel to the axes of the pulse combustors, in most cases these ducts 40 will need to be spiraled upwardly so as to have the length required to achieve the necessary tuning. Alternatively, the pulse combustors can be spiraled instead of straight as shown.

While the invention has been shown and described as embodied in specific apparatus, such showing and description are meant to be illustrative only and not restrictive, since obviously many changes and modifications can be made without departing from the spirit and scope of the invention. For example, the terminal combustion product backflow ducts may be brought down the outside of the primary heat exchanger rather than on the system axes. In this case the several backflow ducts will be fed from individual tuyeres downstream of the secondary heat exchanger 48. Insofar as is presently known, the pulse combustor resonance tube outlets can end at any desired position in the secondary combustion chamber 32, and hence the pulse combustors may be spiraled inwardly, for example. The product backflow ducts as at 58 and associated aerodynamic valves as at 60 may be connected to the combustion chambers as at 18 rather than being terminated in front of the aerodynamic valve inlets as at 20. The secondary air flow ducts as at 40 may be fitted with aerodynamic valves. A half-wavelength duct may be added to the aerodynamic valve inlets as at 20 to avoid ejecting combustion products into the plenum 38 or the secondary air ducts 40.

What is claimed is:

1. Apparatus for burning a fuel and a combustion-sustaining gas, at least one of which contains nitrogen, and for imparting the heat generated thereby to a heat-transfer medium, comprising a first combustion stage including a pulse combustor for burning a mixture of the fuel and the gas, comprising a combustion chamber, aerodynamic valve inlet means, and a resonance-tube outlet means, to operate in a periodic cycle including one phase wherein a major portion of combustion gases is driven out of the combustion chamber through the outlet means and a minor portion is driven out of the combustion chamber so as to produce a backflow through the aerodynamic valve means, and another phase wherein a fresh charge of the combustion-sustaining gas is ingested by the combustor through the aerodynamic valve means, means for supplying the combustion-sustaining gas to the aerodynamic valve means and thence to the pulse combustor, means for supplying fuel to the pulse combustor so as to provide an excess of fuel in relation to the amount of combustion-sustaining gas ingested by the pulse combustor, a second combustion stage including means for receiving the combustion gases from the pulse combustor outlet means and for burning the excess of fuel to produce terminal combustion products, means utilizing the backflow for aspirating combustion-sustaining gas and for delivering the aspirated gas to the second stage for burning with the excess of fuel received there, intercooling means utilizing a heat-transfer medium for extracting from the pulse combustor in the first stage a substantial portion of the heat generated therein, means utilizing a heat-transfer medium for extracting most of the heat from the terminal combustion products produced by the second stage so as to produce substantially cooled combustion products, means for recirculating a portion of the cooled combustion products to the pulse combustor so as to dilute the combustion-sustaining gas supplied thereto, and means for exhausting the remainder of the cooled combustion products with only a low content of objectionable compounds formed from the nitrogen in the fuel and the combustion-sustaining gas.

2. Apparatus for burning a fuel and a combustion-sustaining gas, at least one of which contains nitrogen, and for imparting the heat generated thereby to a heat-transfer medium, comprising a first combustion stage including an array of pulse combustors for burning a mixture of the fuel and the gas, each combustor having a combustion chamber, aerodynamic valve inlet means, and a resonance-tube outlet means, to operate in a periodic cycle including one phase wherein a major portion of combustion gases is driven out of the combustion chamber through the outlet means and a minor portion is driven out of the combustion chamber so as to produce a backflow through the aerodynamic valve means, and another phase wherein a fresh charge of the combustion-sustaining gas is ingested by the combustor through the aerodynamic valve means, a tuned inlet plenum for supplying the combustion-sustaining gas to the aerodynamic valve means and thence to the pulse combustors, means for supplying fuel to the pulse combustors so as to provide an excess of fuel in relation to the amount of combustion-sustaining gas ingested by the pulse combustors, a second combustion stage including means for receiving the combustion gases from the outlet means of the pulse combustors and for burning the excess of fuel to produce terminal combustion products, means utilizing the backflow for aspirating combustion-sustaining gas from the inlet plenum and for delivering the aspirated gas to the second stage for burning with the excess of fuel received there, intercooling means utilizing a heat-transfer medium for extracting from the pulse combustors in the first stage a substantial portion of the heat generated therein, means utilizing a heat-transfer medium for extracting most of the heat from the terminal combustion products produced by the second stage so as to produce substantially cooled combustion products, means for recirculating a portion of the cooled combustion products to the pulse combustors so as to dilute the combustion-sustaining gas supplied thereto, and means for exhausting the remainder of the cooled combustion products with only a low content of objectionable compounds formed from the nitrogen in the fuel and the combustion-sustaining gas.

3. Apparatus as in claim 1 or 2, wherein the cooled combustion products recirculating means comprises duct means that is tuned in accordance with the repetition frequency of the periodic operating cycles of the pulse combustors.

4. Apparatus as in claim 3, wherein the duct means includes aerodynamic valve means.

5. Apparatus as in claim 2, wherein the pulse combustors are arranged in a toroidal array, and the cooled combustion products recirculating means comprises central duct means extending generally along the axis of the toroidal array.

6. Apparatus as in claim 5, wherein at least a portion of the central duct means is split into branches, each connected to a different pulse combustor in the array.

7. Apparatus as in claim 6, wherein each branch includes aerodynamic valve means.

8. Apparatus as in claim 6, wherein each branch is connected to the aerodynamic valve inlet means of one of the pulse combustors.

* * * * *